United States Patent [19]

Besio et al.

[11] Patent Number: 4,849,326

[45] Date of Patent: Jul. 18, 1989

[54] WHITE LIGHT HANDEABLE DIRECT-POSITIVE SILVER HALIDE PHOTOGRAPHIC ELEMENTS

[75] Inventors: Mauro Besio, Vado Ligure/Savona; Alberto Vacca, Carcare/Savona; Angelo Vallarino, Spotorno/Savona, all of Italy

[73] Assignee: Minnesota Mining and Manufacturing Company, St. Paul, Minn.

[21] Appl. No.: 216,506

[22] Filed: Jul. 8, 1988

[30] Foreign Application Priority Data

Jul. 21, 1987 [IT] Italy ..... 21373 A/87

[51] Int. Cl.[4] ..... G03C 1/485

[52] U.S. Cl. ..... 430/512; 430/517; 430/522; 430/596; 430/597; 430/606

[58] Field of Search ..... 430/512, 517, 522, 596, 430/597, 606

[56] References Cited

U.S. PATENT DOCUMENTS

| | | | |
|---|---|---|---|
| 4,045,229 | 8/1977 | Weber, II et al. | 430/522 |
| 4,140,531 | 2/1979 | Jamieson | 96/94 |
| 4,232,116 | 11/1980 | Jamieson | 430/510 |
| 4,495,274 | 1/1985 | Yoshida | 430/523 |

FOREIGN PATENT DOCUMENTS 0146302 6/1985 European Pat. Off. .

*Primary Examiner*—Richard L. Schilling
*Assistant Examiner*—Janet C. Baxter
*Attorney, Agent, or Firm*—Donald M. Sell; Walter N. Kirn; Mark A. Litman

[57] ABSTRACT

UV-sensitive direct positive silver halide photographic elements for duplicating processes which can be safely handled under white light, said elements comprising a support base, a hydrophilic colloidal silver halide emulsion layer comprising fogged silver halide grains, and one or more hydrophilic colloidal layers, wherein said silver halide emulsion is reactively associated with a water-removable UV-absorbing compound having at least 80% of the absorption in the range from 350 to 400 μm.

11 Claims, No Drawings

WHITE LIGHT HANDEABLE DIRECT-POSITIVE SILVER HALIDE PHOTOGRAPHIC ELEMENTS

FIELD OF THE INVENTION

The present invention relates to UV sensitive direct-positive silver halide photographic elements, and more particularly to UV sensitive direct-positive silver halide photographic elements which can be handled under room lighting conditions without significant loss in image density.

BACKGROUND OF THE ART

In recent years, in the field of Graphic Arts, have been introduced direct-positive silver halide photographic elements for duplicating processes. Said elements are designed for exposure to UV light on high powered contact frames which are available for exposing lithographic plates and may be handled in ordinary room light (typically in bright white lighting, in which the term "white light" is defined as the emission of a typical commercially available fluorescent lamp).

It is very desirable to produce silver halide photographic elements for duplicating processes which may be handled safely in bright white light. The benefits of this include ease of working and inspection of the element during exposure and processing, and generally more pleasant working conditions for the operators.

While negative acting silver halide elements are resistant to fogging in room light by making use of an accentuated low intensity reciprocity failure effect, direct-positive silver halide elements do not show this effect to any great extent. For this reason direct positive silver halide elements for duplicating purposes cannot approach the degree of white light safety displayed by negative acting elements.

In the absence of a low intensity reciprocity failure effect, the white light handling characteristics can be effected by acting on the overall speed. Obviously, the slower the speed of a silver halide element with respect to the exposing light, the better its tolerance to room light.

Direct-positive silver halide elements which are intended for exposure to UV emitting lamps (such as metal halide lamps) may be afforded some degree of white light handleability by the use of filter dyes either in the emulsion layer or in a non light-sensitive layer. Typically, the dye will particularly absorb visible light and prevent exposure of the radiation sensitive layer by this light. The filter dye is chosen such as not to interfere in a high extent with intentional exposure to UV radiations. Examples of silver halide elements incorporating said filter dyes are disclosed in U.S. Pat. Nos. 4,140,531, 4,232,116 and 4,495,274 and EP Pat. application Ser. No. 146,302 where blue absorbing dyes are used which are bleachable during processing.

The improvement in white light handling which may be achieved by the use of filter dyes is not normally very great unless very high dye loadings are used. Such high dye loadings tend to cause problems such as a residual dye stain, increase in Dmin (fog) and decrease in contrast. Moreover, the use of filter dyes may chemically interfere with the reversal process and still further exposure beyond the minimum density can sometimes result in an increase of density or re-reversal.

Therefore there is a need in the duplicating films in the field of Graphic Arts to provide UV sensitive direct-positive silver halide photographic elements which can be handled under white light without any significant loss in image density.

SUMMARY OF THE INVENTION

According to the present invention, there is provided a UV sensitive direct-positive silver halide photographic element for duplicating processes which can be safely handled under white light, said element comprising a support, a hydrophilic colloidal silver halide emulsion layer comprising fogged silver halide grains, and one or more hydrophilic colloidal layers, wherein said silver halide emulsion is reactively associated with a water removable UV absorbing compound having at least 80% of absorption in the range of 350 to 400 $\mu$m.

DETAILED DESCRIPTION OF THE INVENTION

The present invention relates to a UV sensitive direct-positive silver halide photographic element comprising a support, a hydrophilic colloidal silver halide emulsion layer comprising fogged silver halide grains, and one or more hydrophilic colloidal layers, wherein said silver halide emulsion is reactively associated with a water removable UV absorbing compound having at least 80% of absorption in the range of 350 to 400 $\mu$m.

Preferably, the UV absorbing compounds for use in the direct-positive silver halide photographic element according to the present invention correspond to the general formula:

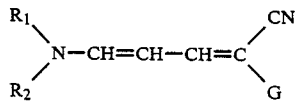

(I)

in which:

$R_1$ and R2, the same or different, each represents an alkyl group, an aryl group or a cyclic alkyl group, or $R_1$ and $R_2$ taken together represent the atoms necessary to complete a cyclic amino group, G represents an electron withdrawing group, and at least one of $R_1$, $R_2$ and G is substituted with a water solubilizing group.

In the above general formula (I):

$R_1$ and $R_2$ can be the same or different and represent alkyl groups, preferably alkyl groups having 1 to 10 carbon atoms, more preferably alkyl groups having 1 to 4 carbon atoms, including substituted alkyl groups such as cyanoalkyl or alkoxyalkyl groups, aryl groups, preferably aryl groups having 6 to 20 carbon atoms, more preferably aryl groups having 6 to 10 carbon atoms or cyclic alkyl groups, preferably cyclic alkyl groups having 5 or 6 carbon atoms or $R_1$ and $R_2$ taken together represent the elements necessary to complete a cyclic amino group such as, for example, a piperidino, a morpholino, a pyrrolidino, a hexahydroazepino and a piperazino group, G represents an electron withdrawing group of any electron withdrawing groups known in the art such as, for example, CN, $NO_2$, COOR or $SO_2R$ wherein R represents an alkyl group, preferably an alkyl group having 1 to 10 carbon atoms, more preferably an alkyl group having 1 to 4 carbon atoms, or an aryl group (such as phenyl or naphthyl), preferably an aryl group having 6 to 20 carbon atoms, more preferably an aryl group having 6 to 10 carbon atoms, and at least one of $R_1$, R2 and G is substituted with a water solubilizing group of any water solubilizing groups known in the art such as for example, a COOH group or an alkaline metal or ammonium salt thereof, a $SO_3H$ group or an alkaline metal or ammonium salt thereof, a hydroxy group, a quaternary ammonium salt containing group, a phosphate group or a polyoxyalkylene group.

More preferably, the UV absorbing compounds for use in the direct-positive silver halide photographic elements according to the present invention correspond to the general formula:

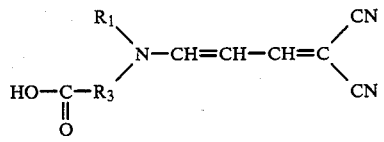

(II)

in which:

$R_1$ represents an alkyl group having 1 to 10 carbon atoms, preferably a lower alkyl group having 1 to 4 carbon atoms such as, for example, methyl, ethyl, propyl, isopropyl, butyl, isobutyl or tert.-butyl group, and $R_3$ represents an alkylene group having 1 to 10 carbon atoms whose carbon atom chain may comprise divalent groups such as, for example, —O—, —S—, —COO— or —$SO_2$—.

The UV absorbing compounds of the photographic elements according to the present invention have a strong absorption in the region of the electromagnetic spectrum at the boundary between the UV and the visible region. The UV absorbing compounds according to this invention have a peak or plateau in its absorbing spectrum around 380 μm. At least 80% of their absorption is in the range of from 350 to 400 μm, their absorption below 350 μm being such as not to affect significantly the response of the silver halide emulsion to the UV radiations of the exposure light, preferably such as not to absorb more than 30% of the radiation emitted by exposure lamps. Additionally, the UV absorbing compounds of the photographic elements according to the present invention are highly soluble in water, so that they can be washed out of the element during processing without a significant retention of UV absorption. Preferably, the absorption of the element after processing is, in the range from 300 μm to 400 μm, less than 0.10.

The following are examples of water soluble UV absorbing compounds which are applicable to the present invention:

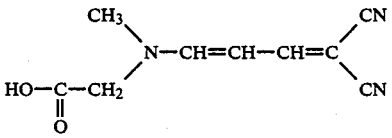

(1)

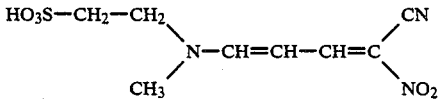

(2)

-continued

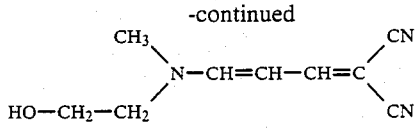

(3)

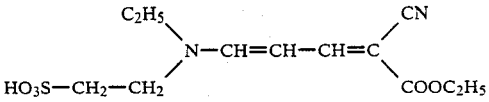

(4)

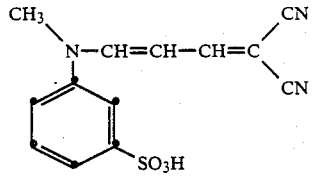

(5)

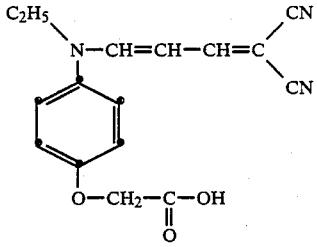

(6)

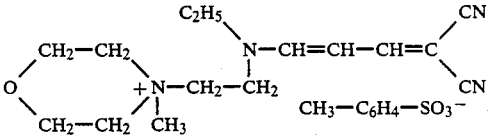

(7)

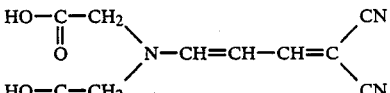

(8)

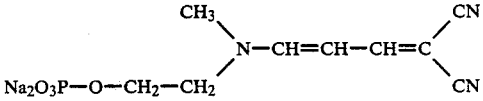

(9)

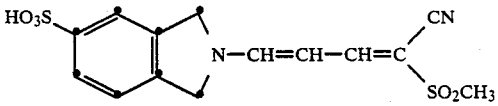

(10)

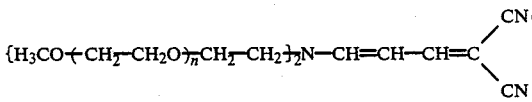

(11)

(wherein n = 12–14)

The UV absorbing compounds of this invention can be prepared according to methods well known in the art. The UV absorbing compounds of general formulas (I) and (II) can be prepared by treating an appropriate amine compound containing the water solubilizing group with an appropriate intermediate in an organic solvent at boiling temperature followed by usual techniques for isolating the compounds. Useful intermediates are for example described in U.S. Pat. No. 4,045,229.

The following is a preparative example of a UV absorbing compound for use in the present invention.

PREPARATIVE EXAMPLE

Compound (1)

N-(3-allylidenemalononitrile)-sarcosine

Sarcosine (89.1 grams, 1 mole) was dissolved in 170 ml of water containing NaOH (40 grams, 1 mole) and 450 ml of methanol. Acetanilidoallylidenemalononitrile (216 grams, 0.91 moles) was then added with stirring. The mixture was refluxed for 30 minutes and then cooled in ice. The addition of 100 ml of 37% HCl separated a yellow colored solid that was filtered and crystallized from a 2:1 ethanol-water mixture. The obtained product (112 grams, yield 65%) had a M.P.=170–2° C.321 and a percent analysis for $C_9H_9N_3O$ as follows:

| | N % | C % | H % |
|---|---|---|---|
| Calculated | 21.98 | 56.54 | 4.74 |
| Found | 21.66 | 56.22 | 4.72 |

Spectrophometric analysis:
λmax (in water) = 374 μm
ε(in water) = 52,000

The product is soluble in water upon addition of a stechiometric quantity of NaOH.

In the photographic elements of this invention, the UV absorbing compounds are used in a hydrophilic colloidal silver halide emulsion layer and/or an adjacent hydrophilic colloidal layer. Preferably said adjacent layer is nearer to the exposure light source than the silver halide emulsion layer. In order to incorporate the UV absorbing compounds into a hydrophilic colloidal layer of the silver halide photographic elements according to this invention, they may be added in the form of a water solution to the hydrophilic colloidal coating composition of a silver halide emulsion layer and/or an adjacent layer. The adding quantity of the UV absorbing compounds, although different according to the type of the compound or of silver halide emulsion to be used, is generally from 0.0001 to 0.1 moles per mole of silver halide, and preferably from 0.001 to 0.01 moles per mole of silver halide. In case of addition to the silver halide emulsion layer, the addition may be made in any step of the process for preparing the direct-positive silver halide emulsion, preferably after having completed the second ripening before coating.

It is well known in the art that silver halides have a high natural sensitivity to UV radiations and that silver bromide also has a relatively high sensitivity to blue and shorter wavelength visible light, while silver chloride has a relatively low sensitivity to blue and to shorter wavelength visible light. Therefore, silver halide emulsions for use in the direct positive photographic elements according to this invention are high chloride silver halide emulsions. They preferably contain at least 50% mole and more preferably at least 75% mole of silver chloride, the higher the silver chloride content, the lower the natural blue and visible light sensitivity, even if the UV radiation sensitivity remains high. More preferably, the silver halide emulsions to be used in direct-positive type photographic elements according to the present invention are emulsions wherein at least 75% by weight of all silver halide grains are silver halide grains wherein at least at 80% mole is silver chloride. The remaining silver halide, if any, will be silver bromide and/or silver iodide but the latter should normally be present in an amount not exceeding 1% mole. In case of silver halides comprising chloride in the range of from 50 to 75% mole, the remaining halide being essentially bromide, the spectral sensitivity is even more extended to visible region and it may be useful to combine the UV absorbing compounds according to this invention with dyes capable of absorbing visible radiations so that the photographic element can be safely handled in bright light conditions. The dyes include, for example, oxonol dyes, benzylidene dyes, and the like, which can be bleachable or washable during processing. Examples of useful dyes are described, for example, in U.S. Pat. No. 4,140,531. In conventional emulsions sensitizing dyes are used to extend the sensitivity of the emulsion to longer wavelengths of visible light. This is not required with the emulsions used in the present invention. It also appears to be desirable for the high chloride silver halide emulsions to have a relatively small grain size, e.g. a mean grain size of from 0.05 to 0.6 micron, the preferred grain size being in the range of from 0.05 to 0.3 microns and the most preferred being from 0.05 to 0.1 micron. The high chloride silver halide grains preferably have a cubic shape, but may have, even less desirable, other shapes.

In the present invention, silver halides are preferably prepared in the presence of at least a doping metallic element of the 8th Group of the Periodic Table of Elements, such as rhodium, iridium and ruthenium, which acts as electron acceptor. Said doping element is preferably chosen among water-soluble iridium salts or water-soluble rhodium salts. Iridium salts include iridium and alkaline metal halides, such as potassium iridium (III) hexachloride and sodium iridium (III) hexabromide. Rhodium salts include rhodium halides, such as rhodium (III) trichloride and rhodium (IV) tetrachloride and rhodium and alkaline metal halides such as potassium rhodium (III) hexabromide and sodium rhodium (III) hexachloride. These salts may be added in a quantity of from $0.5\times10^{-4}$ to $10\times10^{-4}$ moles, and preferably from $2\times10^{-4}$ to $7\times10^{-4}$ moles per mole of silver halide.

The UV sensitive direct-positive silver halide emulsions of the element of this invention are fogged in advance. Namely, the silver halides, after or before water soluble salts have been removed therefrom, may be chemically fogged by any technique known in the art. Fogging may be made either by using a reducing agent alone or by combining a reducing agent with a gold compound. Useful examples of reducing agents include formamidine sulfinic acid (thiurea dioxide), formalin, hydrazine, polyamines, boron compounds such as amineborane and sodium borohydride, stannous chloride and the like. Said reducing agents are generally used in a quantity of from $2\times10^{-6}$ to $2\times10^{-3}$ moles per mole of silver halide.

Gold compounds, used for chemical sensitization during fogging of the silver halide emulsions, include alkali metal chloroaurates, chloroauric acid, gold sulfide, gold selenide, and the like. Said gold compounds are generally used in a quantity of from $1\times10^{-6}$ to $1\times10^{-4}$ moles per mole of silver halide.

The UV sensitive direct-positive silver halide emulsions of the photographic elements according to this invention may contain various other photographic additives which include desensitizers, solarization accelerators, stabilizers, hardeners, coating aids, preservatives, matting agents, antistatic agents, and the like, as described, for example, in U.S. Pat. No. 4,495,274.

Gelatin is generally used as hydrophilic colloid for the silver halide photographic elements of the present invention. As hydrophilic colloids, gelatin derivatives, natural substances such as albumin, casein, agar-agar, alginic acid and the like, and hydrophilic polymers such as polyvinyl alcohol, polyvinylpyrolidone, cellulose ethers, partially hydrolized polyvinyl acetate, and the like can be used in addition to or instead of gelatin. Further, gelatin can be partially substituted with polymer latexes obtained by emulsion polymerization of vinyl monomers, such as polyethylacrylate latexes, to improve the physical characteristics of the photographic layers.

Support bases used in the direct-positive silver halide photographic elements according to this invention can be any of the conventionally used support bases, such as glass, cloth, metal, film including for example cellulose acetate, cellulose acetate-butyrate, cellulose nitrate, polyester, polyamine, polystyrene, and the like, paper including baryta-coated paper, resin-coated paper, and the like.

The direct-positive silver halide photographic elements according to this invention may be used in the field of Graphic Arts for various purposes, such as, for example, for duplicating, for reproduction, for making offset printing masters, as well as in radiography for special purposes, in electron photography, and the like, where high UV sensitivity is required together with low blue light sensitivity.

The direct-positive silver halide photographic elements according to this invention are highly UV sensitive and give high contrast and low minimum density (fog) when they are exposed with light rich in UV rays, they can be handled in bright white room light and minimize re-reversal occurrence when exposed much beyond the minimum density point.

These and other advantages according to the present invention will be illustrated with reference to the following examples.

EXAMPLE 1

A silver halide emulsion containing 64% mole silver chloride and 36% mole silver bromide was prepared by the double jet method in aqueous gelatin in the presence of 0.01 grams of $Na_3RhCl_6.18H_2O$ per mole of silver halide as an electron acceptor compound. The emulsion was composed of cubic grains having a mean particle size of about 0.25 μm. Subsequently, watersoluble salts were removed from the mixture by the coagulation method. This emulsion was added with 3 ml, per silver halide mole, of a $10^{-2}$ molar solution of formamidine sulfinic acid and 0,01 grams (calculated as Au) of $NaAuCl_4$. The emulsion was divided into portions which were prepared for coating with the addition of formaldehyde (hardener) and wetting agents. Further additions were made to the individual portions as indicated in Table 1, followed by coating, at a silver coating weight of 3.3 g/m$^2$, onto a polyethylene terephthalate support base which was backed with a green antihalation layer. The films were exposed through a 0.15 continuous wedge. The exposing lamp was a Philips HPA 2000 UV lamp and the films were exposed for 10″ at 1 meter distance. The room light was that of an Osram 40W type 21 Lumilux TM white lamp.

The exposed films were developed in 3M RDC Developer for 20″ at 40° C. and fixed in 3M Fixroll Fixer. The following Table 1 reports the speed at density of 1 (D1), toe contrast (D2), medium contrast (D3), speed after aging at 60° C. and 50% R.H. (D4), re-reversal value (D5, that is Dmax of negative scale after 80″ exposure) and white light tolerance (D6, that is time above which Dmax is below 4.00 for films exposed to the above Osram lamp at 2 meter distance).

TABLE 1

| Film | Dye | Dye g/m$^2$ | D1 | D2 | D3 | D4 | D5 | D6 |
|---|---|---|---|---|---|---|---|---|
| 1 | — | — | 3.35 | 2.00 | 13.0 | 3.35 | 0.28 | 20″ |
| 2 | Dye A | 0.28 | 2.36 | 1.00 | 6.0 | 2.50 | 0.54 | 1′ |
| 3 | Comp. (1) | 0.13 | 2.47 | 1.20 | 8.0 | 2.48 | 0.32 | 45″ |

The Dye A above is an oxonol dye corresponding to the formula:

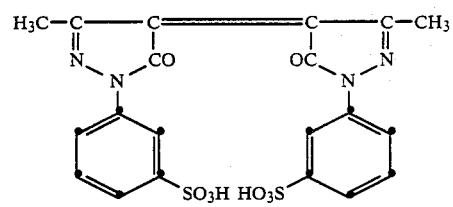

EXAMPLE 2

A series of films was prepared using the procedure described in Example 1. The films were exposed and processed as described in Example 1. The following Table 2 reports the speed at density of 1 (D1), toe contrast (D2), medium contrast (D3), Dmin (D4, that is fog) and white light tolerance (D5, that is Dmax after 1 minute exposure to the above Osram lamp at 2 meter distance).

TABLE 2

| Film | Dye | Dye g/m$^2$ | D1 | D2 | D3 | D4 | D5 |
|---|---|---|---|---|---|---|---|
| 4 | — | — | 3.55 | 2.66 | 13.4 | 0.03 | 0.1 |
| 5 | Dye A | 0.35 | 2.65 | 1.85 | 5.9 | 0.03 | 3.5 |
| 6 | Dye A | 0.70 | 2.34 | 1.70 | 5.3 | 0.05 | 4.7 |
| 7 | Comp. (1) | 0.07 | 2.93 | 2.15 | 9.1 | 0.03 | 3.2 |
| 8 | Dye A + Comp. (1) | 0.25 0.05 | 2.24 | 1.90 | 6.0 | 0.03 | >6.0 |

EXAMPLE 3

A silver halide emulsion containing 84% mole chloride and 16% mole bromide was prepared by adding simultaneously and under stirring, over a period of 25 minutes, with the double-jet technique, water solution B and water solution C to water gelatin solution A, said water solutions having the composition reported hereinbelow.

Solution A

Water—g 833.3
Gelatin—g 2
Polyvinylpyrrolidone (K 30)—g 6.33
KBr—ml 0.167 (1N)

Solution B

Water—g 368
$AgNO_3$—g 170

Solution C

Water—361.3
KCl—g 62.65 (0.84 moles)
KBr—g 19.04 (0.16 moles)
$Na_3RhCl_6.12H_2O$—g 0.200

The gelatin solution was kept at constant temperature of 35° C. The addition rate of solution B was constant, while the addition rate of solution C varied such as to maintain the millivolt of the emulsion thus formed at a value of 120±2 mv measured with a specific electrode for Br ion and a reference electrode of the saturated Ag/AgCl type. The emulsion, wherein the soluble salts had been removed with the conventional coagulation method, had a mean grain diameter of 0.09 μm. The emulsion was then fogged with formamidine sulfinic acid and added with a gold salt, as described in Example 1. The emulsion was divided into portions which were prepared for coating with the addition of formaldehyde (hardener) and a wetting agent. Further additions were made to the individual portions as shown in Table 3 and the portions were then coated, at a silver coverage of 2.3 g/m$^2$, onto a polyethyleneterephthalate support base. The films were exposed and processed as described in Example 1. Table 3 reports the speed at density 1 (D1), the re-reversal value (D2, i.e. Dmax on the negative scale after a 80" exposure) and the resistence to white light (D3, i.e. the time beyond which Dmax is below 4.00 for films exposed to the Osram lamp above at a distance of 2 meters).

TABLE 3

| Film | Dye | Dye g/m$^2$ | D1 | D2 | D3 |
|---|---|---|---|---|---|
| 9 | — | — | 3.07 | 0.04 | 20" |
| 10 | Dye A | 0.135 | 2.76 | 0.14 | 4' |
| 11 | Comp. (1) | 0.020 | 2.65 | 0.04 | 4' |
| 12 | Dye B | 0.240 | 2.71 | 0.23 | 3' |
| 13 | Dye C | 0.090 | 2.69 | 0.22 | 3' |

Samples of phototypesetting paper, exposed to different subjects and developed, were pasted-up on a transparent support. A sheet of each film 9 to 13 was put on the image side of the phototypesetting paper samples, exposed to the UV Philips lamp above through the back of the phototypesetting paper and processed as described in Example 1. The following Table 4 reports the exposure time (D1), the re-reversal value (D2, that is the Dmax in the part of the sheet not covered by the samples of phototypesetting paper) and fog (D3, that is Dmin in the part of each sheet in correspondence of samples of phototypesetting paper).

TABLE 4

| Film | D1 | D2 | D3 |
|---|---|---|---|
| 9 | 80" | 0.03 | 0.03 |
| 10 | 80" | 0.04 | >1.0 |
| 10 | 320" | 0.14 | 0.03 |
| 11 | 200" | 0.04 | 0.03 |
| 12 | 80" | 0.23 | 0.03 |
| 13 | 100" | 0.22 | 0.05 |

Dye B is a polymeric UV absorbing compound corresponding to the (acrylamide-diallylaminoallylidenemalononitrile) copolymer having an acrylamido/diallylaminoallylidenemalononitrile unit ratio of 9, described in U.S. Pat. No. 4,307,184, which is not washable during processing.

Dye C is a hydrophobic UV absorbing compound corresponding to the formula

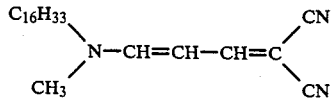

described in European patent application 210,409 which is introduced into the element under the form of a dispersion of hydrophobic organic solvent droplets including it.

We claim:

1. A UV sensitive direct-positive silver halide photographic element comprising a support, a hydrophilic colloidal silver halide emulsion layer comprising fogged silver halide grains, and one or more hydrophilic colloidal layers, characterized in that said silver halide emulsion is reactively associated with a water removable UV absorbing compound having at least of absorption in the range of 350 to 400 μm.

2. The direct-positive silver halide photographic element of claim 1, wherein said UV absorbing compound is represented by the general formula:

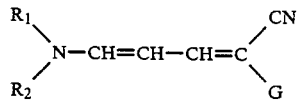

(I)

in which:

$R_1$ and $R_2$, the same or different, each represents an alkyl group, an aryl group or a cyclic alkyl group, or $R_1$ and $R_2$ taken together represent the atoms necessary to complete a cyclic amino group, G represents an electron withdrawing group, and at least one of $R_1$, $R_2$ and G is substituted with a water solubilizing group.

3. The direct-positive silver halide photographic element of claim 1, wherein said UV absorbing compound is represented by the general formula:

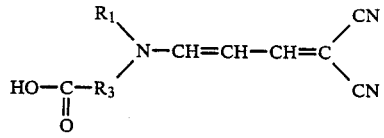

(II)

in which:

$R_1$ represents an alkyl group, and $R_3$ represents an alkylene group.

4. The direct-positive silver halide photographic element of claim 1, wherein the added quantity of said water removable UV absorbing compound is in the range from 0.0001 to 0.1 mole per mole of silver halide.

5. The direct-positive silver halide photographic element of claim 1, wherein said water removable UV absorbing compound is comprised in the silver halide emulsion layer.

6. The direct-positive silver halide photographic element of claim 1, wherein said UV absorbing compound is comprised in a hydrophilic colloid layer.

7. The direct-positive silver halide photographic element of claim 1, wherein said silver halide emulsion is a high chloride silver halide emulsion.

8. The direct-positive silver halide photographic element of claim 1, wherein said silver halide grains have been prepared in the presence of a water soluble iridium salt or a water soluble rhodium salt.

9. A method for introducing safe handling characteristics into a UV sensitive direct-positive silver halide photographic element comprising a support, a hydrophilic colloidal silver halide emulsion layer comprising fogged silver halide grains, and one or more hydrophilic colloidal layers, said method comprising introducing into said element en effective amount of a water removable UV absorbing compound having at least 80% of absorption in the range of 350 to 400 μm.

10. The method of introducing safe handling characteristics into a direct-positive UV sensitive silver halide photographic element of 9, wherein said water removable UV absorbing compound is represented by the general formula:

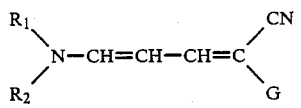

(I)

in which $R_1$ and $R_2$, the same or different, each represents an alkyl group, an aryl group or a cyclic alkyl group, or $R_1$ and $R_2$ taken together represent the atoms necessary to complete a cyclic amino group, G represents an electron withdrawing group, and at least one of $R_1$, $R_2$ and G is substituted with a water solubilizing group.

11. A method of introducing safe handling characteristics into a direct-positive UV-sensitive silver halide photographic element according to claim 9, wherein said water removable UV absorbing compound is represented by the general formula:

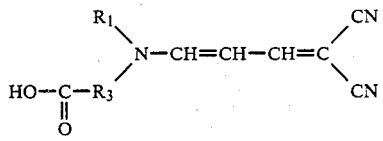

(II)

in which:

$R_1$ represents an alkyl group, and $R_2$ represents an alkylene group.

* * * * *